US005101568A

United States Patent [19]

Ferragamo

[11] Patent Number: 5,101,568

[45] Date of Patent: Apr. 7, 1992

[54] INSTRUMENT FOR MEASURING THE DIMENSIONS OF THE HUMAN FOOT, IN PARTICULAR THE LENGTH AND WIDTH

[75] Inventor: Stefano Ferragamo, Florence, Italy

[73] Assignee: Salvatore Ferragamo Firenze S.p.A., Florence, Italy

[21] Appl. No.: 672,494

[22] Filed: Mar. 20, 1991

[30] Foreign Application Priority Data

Oct. 29, 1990 [IT] Italy ..... 11706/90[U]

[51] Int. Cl.[5] ..... A43D 1/02

[52] U.S. Cl. ..... 33/3 B

[58] Field of Search ..... 33/3 B, 3 A, 3 R, 3 C

[56] References Cited

U.S. PATENT DOCUMENTS 1,029,767 6/1912 Remington ..... 33/3 B 1,495,903 5/1924 Hunt ..... 33/3 B 2,519,677 8/1950 MacKay ..... 33/3 B

*Primary Examiner*—Harry N. Haroian

*Attorney, Agent, or Firm*—Browdy and Neimark

[57] ABSTRACT

The gauge comprises a platform (1) showing a band of parallel curves (3) arranged with points of maximum offset from the longitudinal axis of the platform and reflecting different heel-to-toe lengths which are repeated in a scale (4) marked along the edge flanking the inside of the foot (P); the breadth fit is measured by means of a tape (7) anchored slidably to the scale at one end, which is passed diagonally over the instep and back under the platform, clearing the outside edge, (15*a*), in such a way that graduated markings afforded by the remaining end (*7a*) can be read off against the inside edge.

9 Claims, 2 Drawing Sheets

INSTRUMENT FOR MEASURING THE DIMENSIONS OF THE HUMAN FOOT, IN PARTICULAR THE LENGTH AND WIDTH

DESCRIPTION

1. Field of the Invention

The present invention relates to an instrument that permits of measuring the dimensions of the human foot, and in particular the length and breadth, or in more general terms, of determining length-and-width-related parameters designed to facilitate selection of the size of footwear most suitable for the individual.

2. Description of the Prior Art

Conventionally, the length and breadth of the foot are the two main parameters that must be known in order to provide an item of footwear best suited to a given individual in terms of comfort. A variety of gauges have been developed for the purpose of effecting the relative measurements, consisting almost invariably in a base or platform on which to rest the sole of the foot, of which the front part exhibits a series of parallel lines disposed normal to the longitudinal median axis of the platform and corresponding to the various foot lengths or sizes. Positioning the foot on the platform with the heel against a stop at the rear end, the length or size is duly read off at the toe. The width or breadth dimension is established by passing a measuring tape transversely around the foot substantially from the ball and reading off the value on a part of the tape which projects from the edge of the platform.

Instruments of the type thus described are notably imprecise, firstly by reason of the fact that the measurement effected is the maximum length of the foot from the tip of the toe to the heel, with no account taken of differences in anterior profile that occur from the feet of one individual to those of another, and indeed from one foot to another; secondly, the ball of the foot, used as a breadth reference, gives no more than an indicative result since the ball is not always separated from the heel by the same distance. Another factor tending to compound the inexact and empirical measurement afforded by gauges of the type in question, is that the stop is offered to the soft part of the heel, and the resultant length reading can vary according to the degree of firmness with which the heel is placed against the stop.

The object of the present invention is to provide an instrument such as will assist in determining the optimum size or footwear for a given individual by enabling a measurement of length-and-breadth-related parameters, that is more exact and less prone to error than the type of measurement afforded by gauges in current use.

SUMMARY OF THE INVENTION

The stated object is realized in an instrument as characterized in the appended claims; according to the invention, such an instrument comprises a base or platform on which to rest the sole of the foot, of which the front section exhibits a plurality of mutually parallel reference lines set at identical distance one from the next and corresponding to the different lengths or sizes, each consisting in a curve having a point of maximum that is offset from the longitudinal median axis of the platform. Such an instrument further comprises a scale along one side of the base or platform, indicating the lengths or sizes, and a measuring tape slidably associated with the scale at one end, which is disposed at a selected angle in relation to the longitudinal axis and insertable through a guide rigidly associated with the sliding end.

BRIEF DESCRIPTION OF THE DRAWINGS

The invention will now be described in detail, by way for example, with the aid of the accompanying drawings, in which.

DESCRIPTION OF THE PREFERRED EMBODIMENTS

Figure 1:
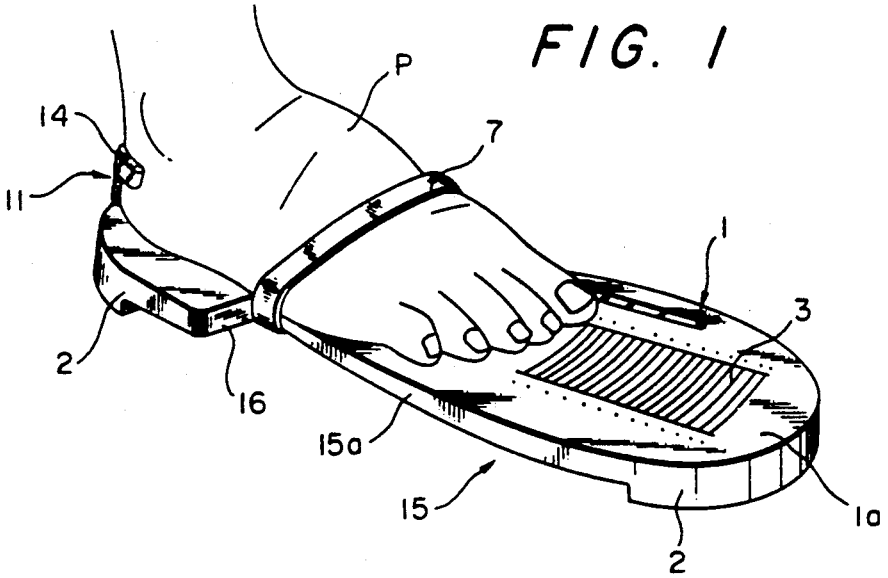
FIG. 1 is a perspective of the instrument according to the invention, illustrated in use.
Figure 2:
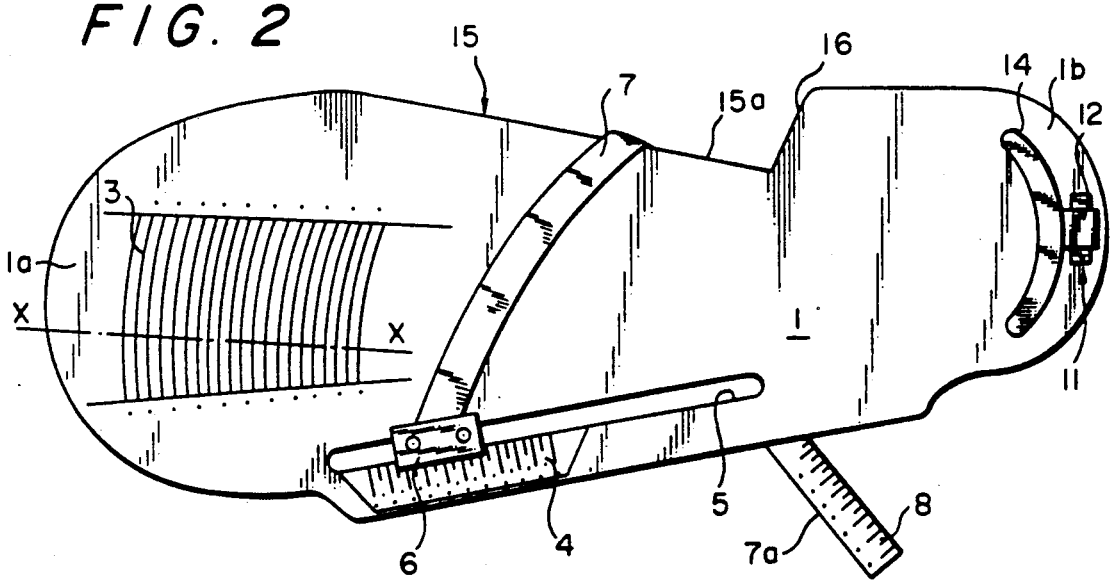
FIG. 2 shows a top plan view of the instrument of FIG. 1.
Figure 3:
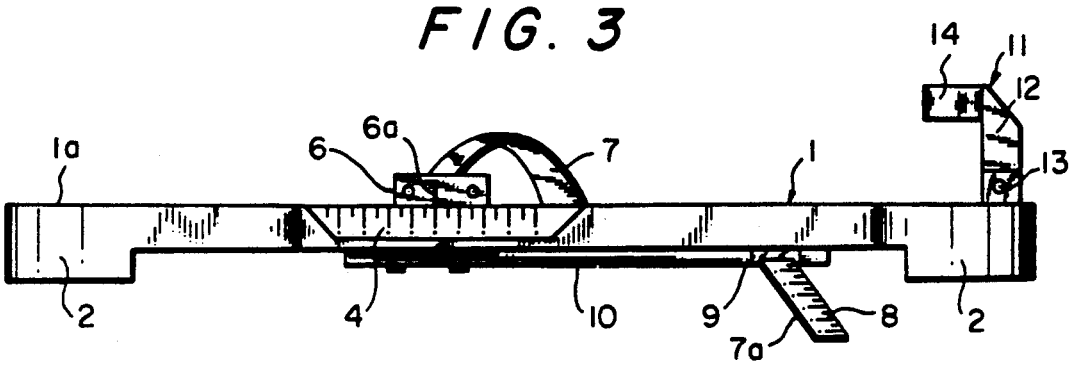
FIG. 3 shows a side elevation view of the instrument of FIG. 1.

Referring to FIG. 1 to 3, the instrument according to the invention comprises a base or platform 1 on which to rest the foot P of an individual, embodied in metal, for example, and exhibiting the outline essentially of a footprint; base 1 is supported by two thickened portions 2 located at the front and rear ends respectively. A front area 1*a* of the platform, exhibits a band of curves 3 running transversely to the longitudinal median axis of the platform, disposed mutually parallel and spaced at identical distance one from the next, each corresponding to a size of footwear or alternatively to an absolute length measurement of the foot P.

The point of maximum on each curve 3 is offset from the longitudinal median axis of the platform, and more exactly, to the left of the axis on the case of instruments for the measurement of a right foot, and to the right in the case of an instrument for the measurement of a left foot. FIGS. 1–4 show an instrument for the measurement of a right foot, it being understood that an instrument for the measurement of a left foot would be a mirror image of that shown in FIGS. 1–4. In practice, the curves reflect a nominal profile along which the extremities of the toes of the foot are aligned. To the end of matching each of the various curves as closely as possible to such a profile according to the length of the foot, the maximum points of the curves are aligned along an axis X that is angled in relation to and converges with the median axis toward the forward end of the platform 1.

A graduated scale 4 is marked on the edge of the platform 1, along the side nearest the maximum points of the curves 3, which reflects the range of sizes of footwear or the lengths from heel to toe covered by the band of curves. A through slot 5 formed on platform 1 and extending alongside and parallel to the scale 4 slidably accomodates an element 6 to which one end of a tape 7 is anchored. Tape 7 extends transversely across the platform 1 and is of length such that the remaining end 7*a* can be passed over the foot P (FIG. 1) then back under the platform 1 to project on the same side as that occupied by the graduated scale 4. The same projecting end 7*a* of the tape 7 exhibits a graduated scale 8 of breadth measurements, which are read off against the edge of the platform and provide a standard reference on which to establish the breadth of the individual's foot. The graduated end 7*a* of the tape is inserted through a guide slot 9 formed in a rod 10 rigidly associated with the slider 6 and extending along the underside of the platform 1. To ensure greater precision when effecting the breadth measurement, the tape 7 extends at an angle toward the rear end of the platform 1, in relation to the longitudinal median axis, in such a way as to pass over the high part of the instep.

Edge 15 of the base or platform 1 opposite to that occupied by scale 4 affords a recess 16 coinciding with the area at which the heel section merges with the transverse median section, in such a way that the width of the platform at this point will measure less than the width of a foot of the smallest size in the range for which the instrument is designed. Accordingly, even the slimmest foot will project marginally from the platform 1 at the point where the tape 7 is passed around and under. The innermost corner of the recess 16 is joined to the forward end of the platform 1 by a stretch 15*a* of the edge 15 which diverges from the median axis in such a manner that feet of progressively larger sizes, however slim, will be certain to project marginally at the point where a breadth measurement is taken; the divergent angle thus ensures that tape 7 will not register with edge 15*a* of the platform rather than with the foot, and produce a false measurement.

A stop 11 is associated with the rear end 1*b* of the platform 1, against which the heel of the foot P abuts, and consists in an arm 12 hinged to the platform about a pivot 13; the projecting end of arm 12 affords a rigid concave rest 14 designed to cradle the upper, farthest projecting part of the heel. Rest 14 can thus wrap closely around the heel, preventing the foot from shifting or becoming wrongly positioned on the platform 1 and giving a false measurement. The hinged arm 12 can be folded forward and down to reduce the bulk of the gauge when not in use.

The first step in utilization of the instrument according to the invention is to place the foot P of an individual on the platform 1, making certain to position the heel correctly against the rest 14 and offer the ball of the foot to the slider 6, which functions as a lateral stop. The length is the read off directly from the band of curves 3.

More exactly, the curve reflecting the effective length of the foot (or the size of footwear) will be the first curve lying completely clear of all the toes. The next step is to locate this length on graduated scale 4 at the side of the platform, and to position tape 7 accordingly by aligning an indicator 6*a*, afforded by slider 6, with the relative mark (FIG. 3). Tape 7 is then passed over the foot and through the slot 9, and the width measurement read off at the scale 8 afforded by its projecting end 7*a*.

Figure 4:
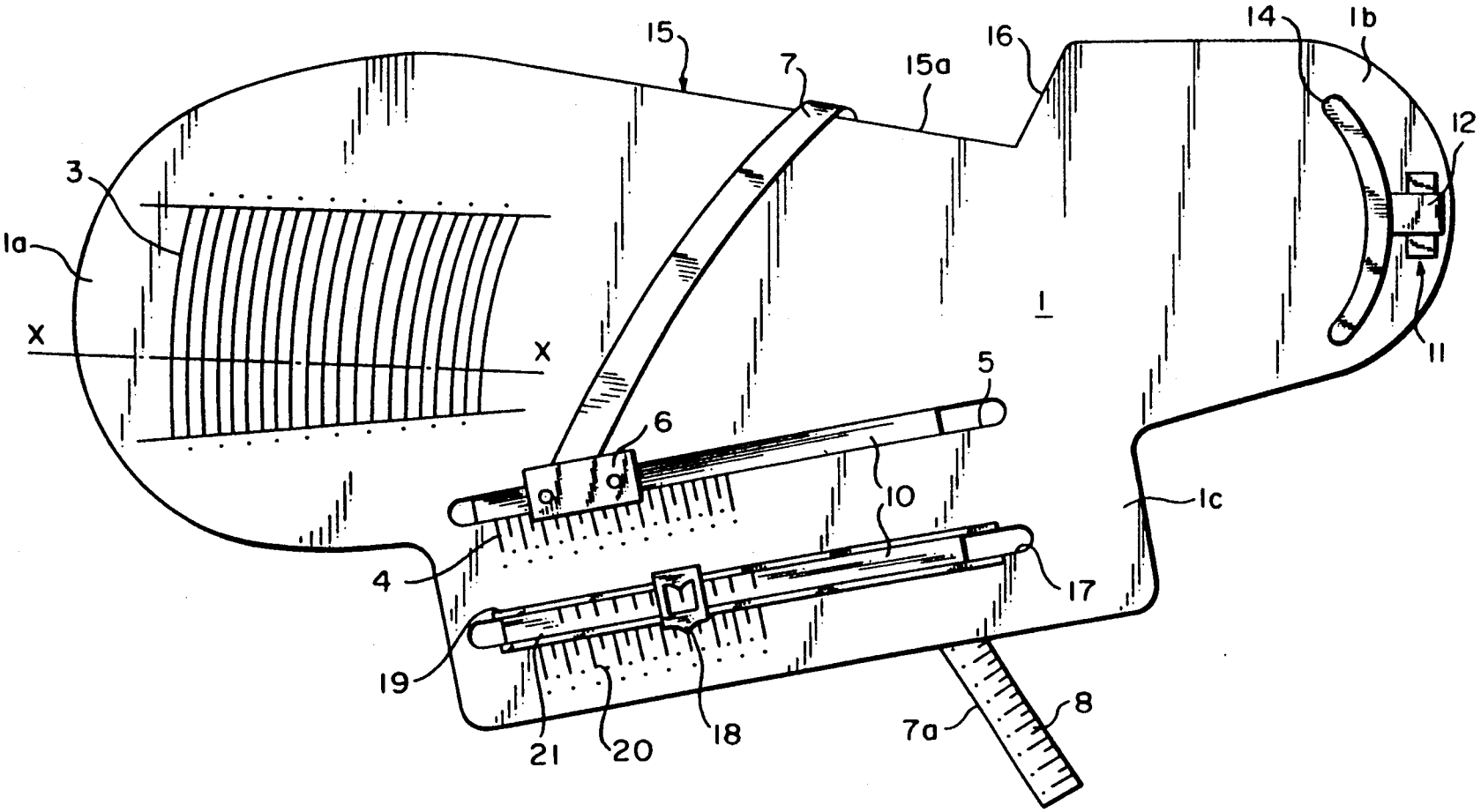
FIG. 4 shows another embodiment of the instrument according to the invention in a top plan view.

Clearly enough, the curves 3 and the scale 8 can be graduated numerically in a variety of ways, for example utilizing absolute metric and/or imperial measurements, or with parametric values responding simply to internal standards of the manufacturer, or designed for use in conjunction with reference tables and/or charts from which the most suitable size of footwear can be deduced from the readings given by the instrument. From the foregoing, it is in fact apparent that for a found foot length several foot width are possible. In other words, a foot of given length may be more or less slender or more or less squat and consequently require that the appropriate shape be chosen among shoes with the same length. This can be obtained either by means of reference tables and/or charts as mentioned above or, according to the present invention, by providing the instrument with a further graduated scale for determining the size of a shoe given the length and the width of a foot. As shown in FIG. 4, platform 1 has a side expansion 1*c* extending beside through slot 5. A second through slot 17 is formed on side expansion 1*c* parallel to slot 5 and rod 10 also extend under slot 17. A slider 18 is slidingly mounted on guide 19 extending down the sides of slot 17 and a graduated scale 20, corresponding to the width of the foot is provided alongside slot 17. A size scale 21 is provided on the part of rod 10 that is visible from slot 17, said scale 21 being for example of the type AAAA, AAA, . . . D for women and of the type A, B, . . . EEE for men. The position of the size scale 21 with respect to width scale 20 is authomatically defined when positioning slider 6 in correspondance of the appropriate point of length scale 4, because slider 6 is integral with rod 10. After the width of the foot has been measured by means of tape 7 and width scale 8 on tape end 7*a*, slider 18 is displaced to meet the corresponding width value on the width scale 20 and to read the shoe size on the scale 21 indicated by slider 18.

I claim:

1. An instrument for measuring the dimensions of the human foot, in particular, length and breadth or parameters relating to length and breadth, comprising:

a platform for resting the sole of the foot;

a heel stop at rear of said platform;

said platform having a forward section having a plurality of mutually parallel reference lines spaced apart an identical distance from one another;

said reference lines marked to indicate different heel-to-toe length measurements;

said reference lines comprising a plurality of curves with a point of said curves furthest from a back of said heel rest offset from a longitudinal median axis of said platform;

at least one graduated scale corresponding to said length measurements marked along one side of said platform;

a measuring tape connected at one end to a sliding indicator mounted adjacent to said at least one graduated scale;

said measuring tape extending from said sliding indicator at a prescribed angle in relation to said longitudinal median axis of said platform; and said measuring tape having a second end insertable through a guide on said sliding indicator.

2. An instrument according to claim 1, wherein said point of said curves furthest from said back of said heel rest are intersected by a straight line angled in relation to said longitudinal median axis of said platform and converging therewith toward a forward end of said platform.

3. An instrument according to claim 1, wherein said sliding indicator serves to align said foot on said platform for measurement.

4. An instrument according to claim 1, wherein the scale of measurements is flanked by a slot passing through said platform and slidably accommodating said sliding indicator to which one end of the measuring tape is anchored.

5. An instrument according to claim 1, wherein said guide for said graduated tape comprises a passage formed through a part of said sliding indicator located underneath said platform.

6. An instrument according to claim 1, wherein said heel stop has a height such as to engage the uppermost and farthest projecting part of the heel.

7. An instrument according to claim 6, wherein said heel stop is pivotally displaceable forward and down onto said platform.

8. An instrument according to claim 1, wherein the width of said platform across the median transverse section, around which the tape is passed to establish the breadth dimension, measures less than the width of a foot corresponding to the smallest size within the range covered by the instrument.

9. An instrument according to claim 1, further comprising a side expansion of said platform, a second slot formed on said expansion and a second sliding indicator movable along said slot, a graduated scale for the width measurements along said second slot associated to said second sliding indicator underneath said platform extending to below said second slot and exhibiting a shoe size scale visible from said second slot and extending along the path of said second sliding indicator.

* * * * *